US010173423B2

(12) United States Patent
Kobayashi

(10) Patent No.: US 10,173,423 B2
(45) Date of Patent: Jan. 8, 2019

(54) PASSAGE MEMBER, LIQUID DISCHARGE HEAD USING SAME, AND RECORDING DEVICE

(71) Applicant: KYOCERA Corporation, Kyoto-shi, Kyoto (JP)

(72) Inventor: Hiroki Kobayashi, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/551,533

(22) PCT Filed: Feb. 17, 2016

(86) PCT No.: PCT/JP2016/054573

§ 371 (c)(1),
(2) Date: Aug. 16, 2017

(87) PCT Pub. No.: WO2016/133117

PCT Pub. Date: Aug. 25, 2016

(65) Prior Publication Data

US 2018/0037028 A1 Feb. 8, 2018

(30) Foreign Application Priority Data

Feb. 18, 2015 (JP) ..... 2015-029723

(51) Int. Cl.
*B41J 2/14* (2006.01)
*B41J 2/16* (2006.01)

(52) U.S. Cl.
CPC ..... *B41J 2/1433* (2013.01); *B41J 2/14209* (2013.01); *B41J 2/1609* (2013.01); *B41J 2/1623* (2013.01)

(58) Field of Classification Search
CPC .... B41J 2/1433; B41J 2/14209; B41J 2/1609; B41J 2/1623
See application file for complete search history.

(56) References Cited

U.S. PATENT DOCUMENTS

| | | | |
|---|---|---|---|
| 2002/0105567 | A1 | 8/2002 | Yamada et al. |
| 2005/0104937 | A1 | 5/2005 | Mita |
| 2005/0248626 | A1 | 11/2005 | Akahane et al. |
| 2006/0176332 | A1 | 8/2006 | Chikamoto |
| 2013/0242012 | A1 | 9/2013 | Hayashi et al. |

FOREIGN PATENT DOCUMENTS

| | | | |
|---|---|---|---|
| EP | 1679194 a1 | * | 4/2006 |
| JP | 2002-205404 A | | 7/2002 |
| JP | 2002-234167 A | | 8/2002 |

(Continued)

OTHER PUBLICATIONS

International Search Report, PCT/JP2016/054573, dated May 17, 2016, 2 pgs.

(Continued)

*Primary Examiner* — Jason S Uhlenhake
(74) *Attorney, Agent, or Firm* — Volpe and Koenig, P.C.

(57) ABSTRACT

A passage member of the present disclosure includes a plurality of plates including openings forming a passage through which a liquid flows and stacked through an adhesive. In at least one plate, a plurality of adhesive spill holes are arranged at substantially the same distances from the opening, so as to surround the opening.

14 Claims, 6 Drawing Sheets

(56) References Cited

FOREIGN PATENT DOCUMENTS

| | | | |
|---|---|---|---|
| JP | 2004-098676 | A | 4/2004 |
| JP | 2005-119293 | A | 5/2005 |
| JP | 2005-238761 | A | 9/2005 |
| JP | 2006-187967 | A | 7/2006 |
| JP | 2007-253439 | A | 10/2007 |
| JP | 2011-016271 | A | 1/2011 |
| JP | 2013-188907 | A | 9/2013 |

OTHER PUBLICATIONS

Extended European Search Report, European Application No. 16752503.
9, dated Jan. 11, 2018, 7 pgs.

* cited by examiner

PASSAGE MEMBER, LIQUID DISCHARGE HEAD USING SAME, AND RECORDING DEVICE

TECHNICAL FIELD

The present disclosure relates to a passage member, a liquid discharge head using the same, and a recording device.

BACKGROUND ART

Conventionally, as a liquid discharge head, for example there has been known an ink jet head for performing various types of printing by discharging a liquid onto a recording medium. As a passage member provided with discharge openings and pressurizing chambers used for a liquid discharge head, there has been known a member comprised of a stack of a plurality of metal plates in which openings and grooves becoming passages are formed. These metal plates are joined by an adhesive. In order to keep the adhesive from flowing into the openings and grooves at the time of joining the plates, adhesive spill grooves are formed in ring shapes around the openings and grooves in the metal plates. These ring-shaped spill grooves are connected to each other (see for example Patent Literature 1).

CITATION LIST

Patent Literature

Patent Literature 1: Japanese Patent Publication No. 2006-187967A

SUMMARY OF INVENTION

A passage member of the present disclosure includes a plurality of plates including openings forming a passage through which a liquid flows and stacked through an adhesive. In at least one of the plates, a plurality of adhesive spill holes are arranged at substantially the same distances from the opening so as to surround the opening.

Further, a liquid discharge head of the present disclosure includes a passage member for the liquid discharge head and pressurizing parts pressurizing the liquid in the passage.

Further, a recording device of the present disclosure includes the liquid discharge head, a conveyor part conveying a recording medium with respect to the liquid discharge head, and a control part controlling the liquid discharge head.

DESCRIPTION OF EMBODIMENTS

Figure 1A:
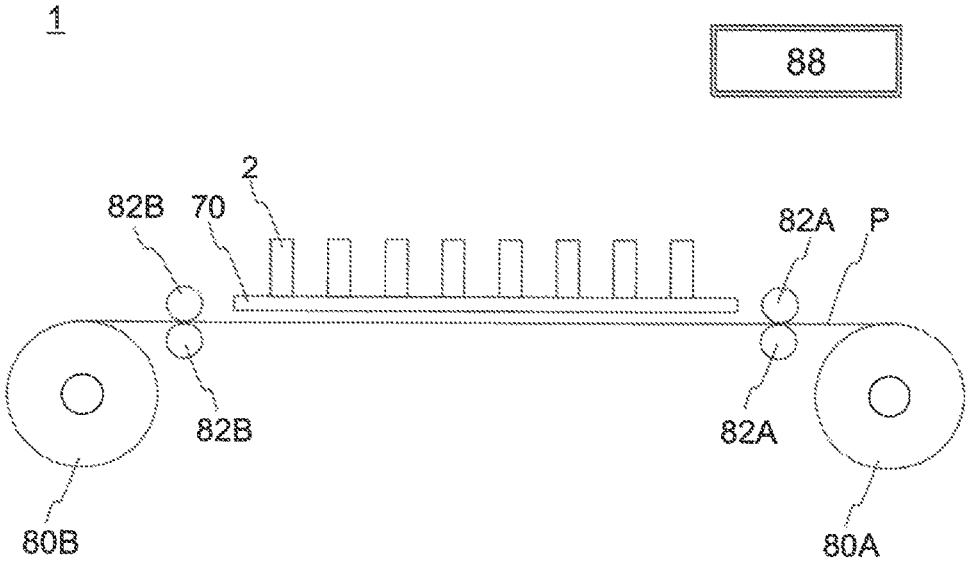
FIG. 1A is a side view of a recording device including a liquid discharge head according to an embodiment of the present disclosure.
Figure 1B:
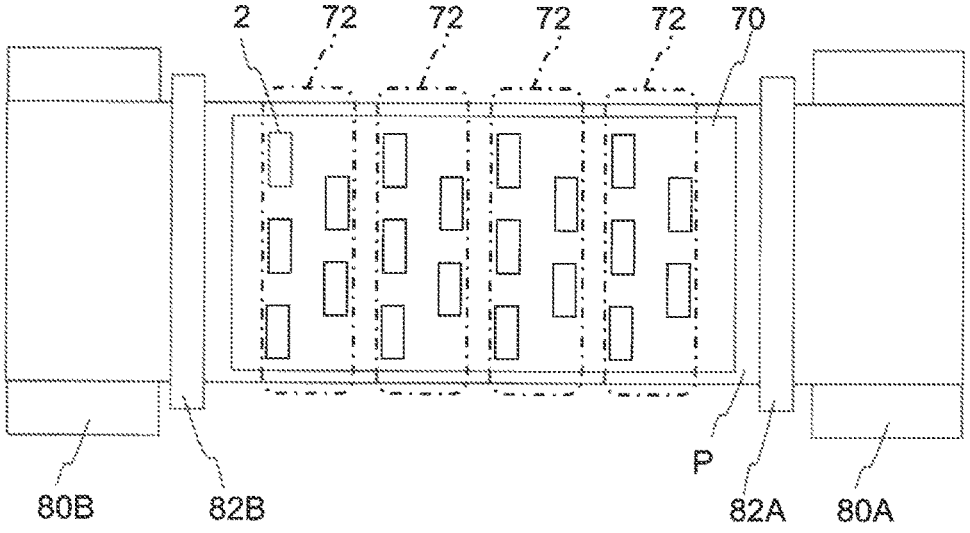
FIG. 1B is a plan view of the same.

FIG. 1A is a schematic side view of a color ink jet printer 1 (below, sometimes simply referred to as a "printer") as a recording device including liquid discharge heads 2 according to an embodiment of the present disclosure, while FIG. 1B is a schematic plan view of the same. The printer 1 conveys a printing paper P as a recording medium from a conveyor roller 80A to a conveyor roller 80B so as to make the printing paper P move relative to the liquid discharge heads 2. A control part 88, based on the image and text data, controls the liquid discharge heads 2 to make them discharge liquid toward the printing paper P, make droplets strike the printing paper P, and thereby executes recording such as printing on the printing paper P.

In the present embodiment, the liquid discharge heads 2 are fixed with respect to the printer 1. The printer 1 is a so-called "line printer". As another embodiment of the recording device in the present disclosure, there can be mentioned a so-called serial printer which alternately performs an operation of moving the liquid discharge heads 2 in a direction crossing the direction of conveyance of the printing paper P, for example an almost perpendicular direction, by reciprocating movement or the like, and conveyance of the printing paper P.

On the printer 1, a flat plate-shaped head mount frame 70 (below, sometimes simply referred to as a "frame") is fixed so as to be substantially parallel to the printing paper P. In the frame 70, 20 not shown holes are provided, 20 liquid discharge heads 2 are mounted at the parts of the individual holes, and the portions discharging the liquid in the liquid discharge heads 2 face the printing paper P. The distance between the liquid discharge heads 2 and the printing paper P is set to for example about 0.5 to 20 mm. Five liquid discharge heads 2 configure one head group 72, and the printer 1 has four head groups 72.

Each liquid discharge head 2 has a long shape elongated in a direction from the front side to the back of FIG. 1A, that is, in the vertical direction in FIG. 1B. This long direction will be sometimes referred to as the "longitudinal direction". In one head group 72, three liquid discharge heads 2 are aligned along a direction intersecting the conveyance direction of the printing paper P, for example, a direction substantially perpendicular to that. The other two liquid discharge heads 2 are arranged at offset positions along the conveyance direction so that one each is positioned between two liquid discharge heads 2 among the above three. The liquid discharge heads 2 are arranged so that ranges able to be printed by the liquid discharge heads 2 are connected in the width direction of the printing paper P (in the direction intersecting the conveyance direction of the printing paper P) or so that their ends are superimposed on each other, therefore printing without gaps in the width direction of the printing paper P becomes possible.

Four head groups 72 are arranged along the conveyance direction of the printing paper P. To each of the liquid discharge heads 2, a liquid, for example ink, is supplied from a not shown liquid tank. Ink of same color is supplied to the liquid discharge heads 2 belonging to one head group 72. Therefore, ink of four colors can be printed by the four head groups 72. The colors of the ink discharged from the head groups 72 are for example magenta (M), yellow (Y), cyan (C), and black (B). If printing by controlling such ink by the control part 88, color images can be printed.

The number of liquid discharge heads 2 mounted in the printer 1 may also be one so long as the printing is carried out monochromatically in a range printable by one liquid discharge head 2. The number of liquid discharge heads 2 included in a head group 72 and the number of head groups 72 can be suitably changed according to what is being printed and the printing conditions. For example, the number of head groups 72 may be increased as well in order to perform further multicolor printing. Further, if a plurality of head groups 72 for printing the same color are arranged and printing is alternately carried out in the conveyance direction, the conveyance speed can be made faster even if using liquid discharge heads 2 having the same performances. Due to this, the area printed per time can be increased. Further, the resolution in the width direction of the printing paper P may be raised by preparing a plurality of head groups 72 printing in the same color and arranging them offset in a direction crossing the conveyance direction.

Further, other than printing of colored ink, a coating agent or other liquid may be printed for surface treatment of the printing paper P.

The printer 1 prints on the printing paper P as a recording medium. The printing paper P is in a state wound on a paper feed roller 80A, passes between two guide rollers 82A, and then passes under the liquid discharge heads 2 mounted in the frame 70. After that, it passes between two conveyor rollers 82B and is finally collected by a collection roller 80B. At the time of printing, by making the conveyor roller 82B rotate, the printing paper P is conveyed at a constant speed and is printed by the liquid discharge heads 2. The collection roller 80B winds up the printing paper P sent from the conveyor rollers 82B. The conveyance speed is for example controlled to 50 m/min. Each roller may be controlled by the control part 88 or may be manually operated by a man.

The recording medium may be a roll-shaped fabric etc. other than the printing paper P. Further, in place of directly conveying the printing paper P, the printer 1 may directly convey a conveyor belt and place the recording medium on the conveyor belt to convey the same. By such a way, a sheet of paper, cut out fabric, wood, tile, and so on can be used as the recording medium. Further, by discharging a liquid containing conductive particles from the liquid discharge heads 2, interconnect patterns etc. of an electronic apparatus may be printed as well. Furthermore, chemical products may be prepared also by making the liquid discharge heads 2 discharge predetermined amounts of liquid chemical agents or a liquid containing chemical agents toward a reaction vessel or the like to cause a reaction etc.

Further, a position sensor, speed sensor, temperature sensor, and the like may be attached to the printer 1. The control part 88 may control parts of the printer 1 in accordance with the states of the parts in the printer 1 which are learned from information from the sensors. For example, in a case where the temperature of the liquid discharge heads 2, the temperature of the liquid in the liquid tank, the pressure which is applied by the liquid in the liquid tank to the liquid discharge heads 2, and so on influence the discharge characteristics (discharge amount, discharge speed, etc.) of the liquid which is discharged etc., a drive signal for discharging the liquid may be changed in accordance with that information as well.

Figure 2:
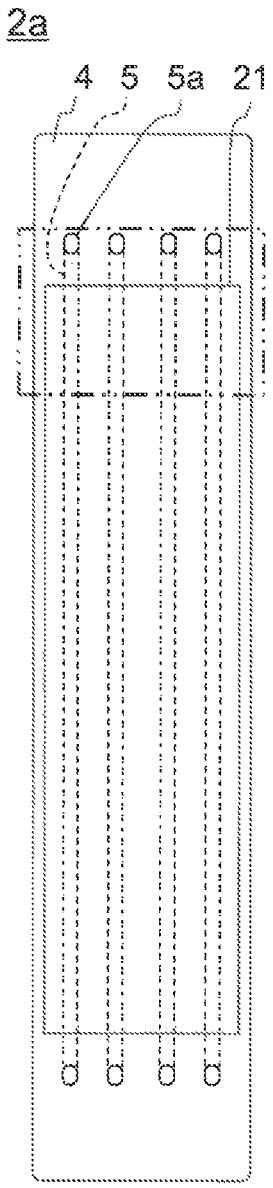
FIG. 2 is a plan view of a head body which is a principal part of the liquid discharge head in FIGS. 1A and 1B.
Figure 3:
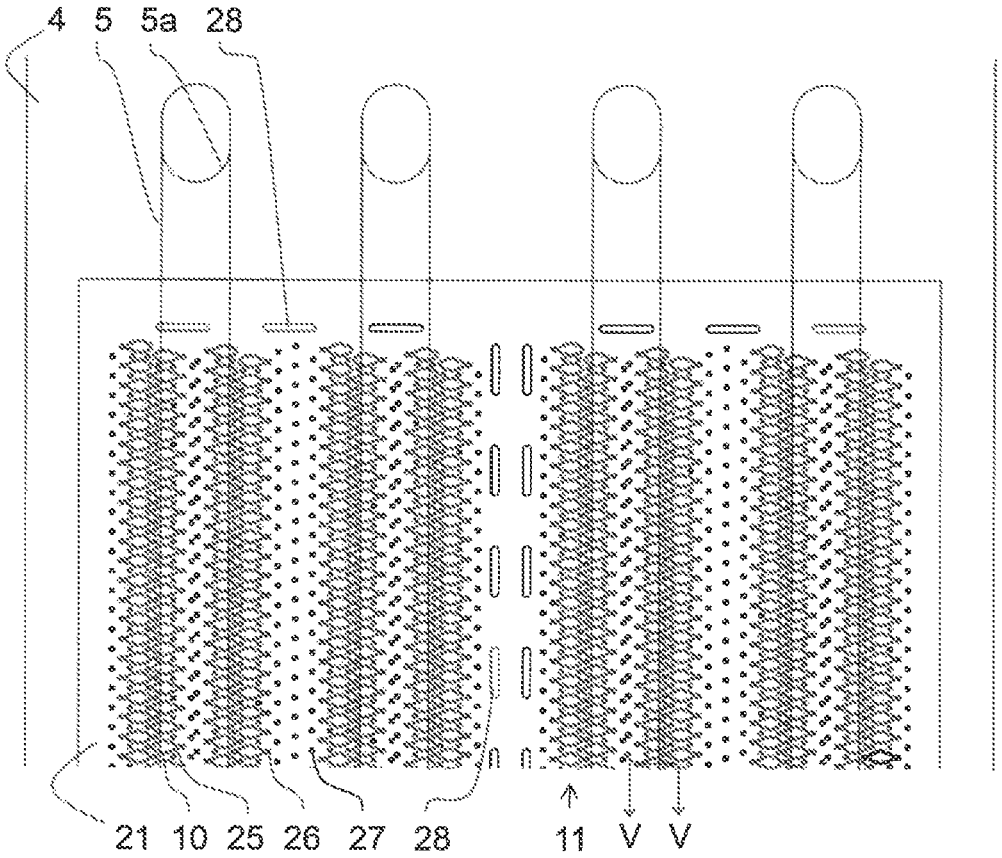
FIG. 3 is an enlarged view of a region surrounded by a two-dot chain line in FIG. 2 in which part of the passages are omitted for the explanation.
Figure 4:
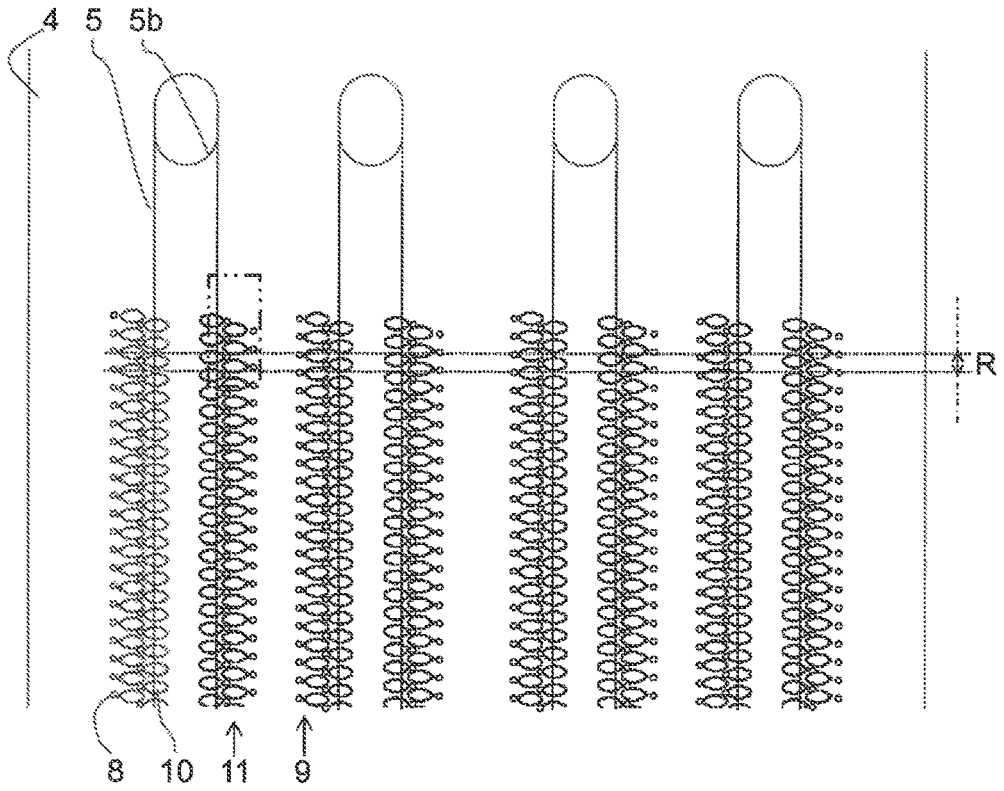
FIG. 4 is an enlarged view of a region surrounded by a two-dot chain line in FIG. 2 in which part of the passages are omitted for the explanation.
Figure 5A:
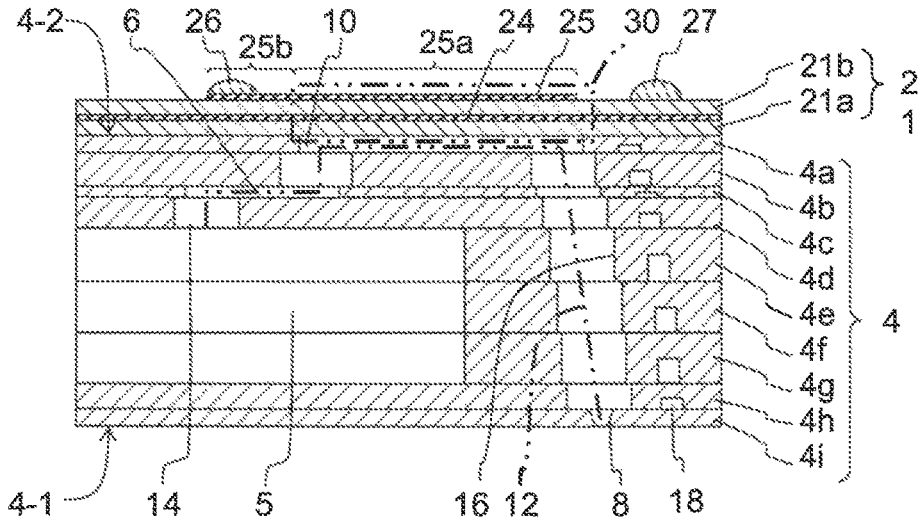
FIG. 5A is a vertical cross-sectional view along a line V-V in FIG. 3.
Figure 5B:
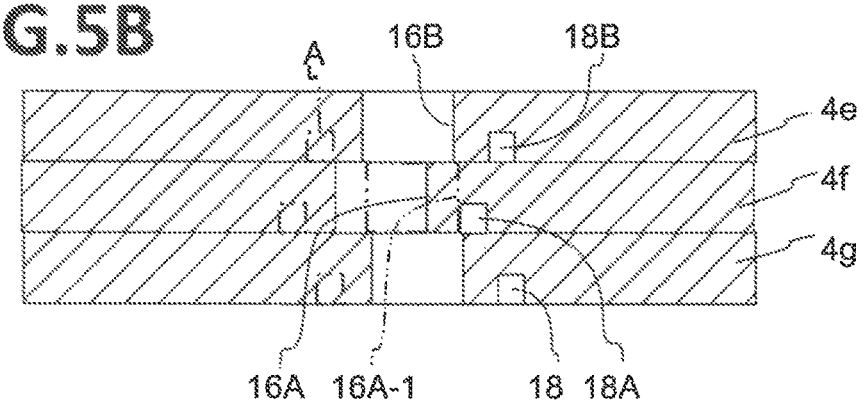
FIG. 5B is an enlarged view of a part of FIG. 5A when stacking offset occurs.

Next, the liquid discharge heads 2 in the present disclosure will be explained. FIG. 2 is a plan view of the head body 2*a*. FIG. 3 is an enlarged view of a region surrounded by a two-dot chain line in FIG. 2 and omits a part of the passages for the explanation. FIG. 4 is an enlarged view of the same region as that in FIG. 3 and omits a part of the passages different from FIG. 3 for the explanation. Note that, in FIGS. 2 to 4, for easier understanding of the drawings, manifolds 5, discharge openings 8, pressurizing chambers 10, and so on which are located beneath the piezoelectric actuator substrate 21 and should be drawn by broken lines are drawn by solid lines. FIG. 5A is a vertical cross-sectional view along a line V-V in FIG. 3, while FIG. 5B is a vertical cross-sectional view enlarging parts of the plates in FIG. 5A.

A liquid discharge head 2 may include, other than a head body 2*a*, a housing made of metal, a driver IC, a circuit board, and the like as well. The head body 2*a* includes a passage member 4 and the piezoelectric actuator substrate 21 in which displacement elements 30 as pressurizing parts are fabricated.

The passage member 4 configuring the head body 2*a* is provided with manifolds 5, a plurality of pressurizing chambers 10 which are connected to the manifolds 5, and a plurality of discharge openings 8 which are respectively connected to the plurality of pressurizing chambers 10. The pressurizing chambers 10 open in the upper surface of the passage member 4, so the upper surface of the passage member 4 becomes a pressurizing chamber surface 4-2. Further, in the upper surface of the passage member 4, openings 5*a* connected with the manifolds 5 are opened. The liquid is supplied through these openings 5*a*.

To the upper surface of the passage member 4, the piezoelectric actuator substrate 21 including the displacement elements 30 is joined. The displacement elements 30 are arranged so that they are positioned over the pressurizing chambers 10. Further, to the piezoelectric actuator substrate 21, a signal transmission part such as an FPC (flexible printed circuit) for supplying signals to the displacement elements 30 is connected.

Four manifolds 5 are arranged inside the passage member 4. Each manifold 5 has an elongated shape extending along the longitudinal direction of the passage member 4. At the two ends, openings 5*a* of the manifold 5 are formed in the upper surface of the passage member 4. The four manifolds 5 are independent from each other.

The passage member 4 is formed by the plurality of pressurizing chambers 10 spread out two-dimensionally. The pressurizing chambers 10 are hollow regions having substantially diamond configuration planar shapes with rounded corner portions. The pressurizing chambers 10 open in the pressurizing chamber surface 4-2 which is the upper surface of the passage member 4.

The pressurizing chambers 10 are linked with one manifold 5 through individual supply channels 14. Along one manifold 5, two each rows of pressurizing chambers 10 linked with that manifold 5, that is, pressurizing chamber rows 11, are arranged on the two sides of the manifold 5, that is, four rows 11 in total are arranged. Accordingly, as a whole, 16 pressurizing chamber rows 11 are arranged. In each of the pressurizing chamber rows 11, the distances in the longitudinal direction between the pressurizing chambers 10 are the same and become distances of 37.5 dpi. Note that, the pressurizing chamber 10 on the end of each pressurizing chamber row 11 is a dummy, so is not connected to the manifold 5. Due to this dummy, the structure at the periphery of the pressurizing chamber 10 one position inside from the end and the rigidity influenced by that approach the structures of the other pressurizing chambers 10 and the rigidities influenced by those, therefore the difference of liquid discharge characteristics can be reduced.

The pressurizing chambers 10 belonging to each pressurizing chamber rows 11 are arranged so that they become zigzag in two adjoining pressurizing chamber rows 11, so the corner portions of the pressurizing chambers 10 which are adjacent to each other are alternately arranged. One pressurizing chamber group is configured by four pressurizing chamber rows 11 which are connected to one manifold 5, and there are four pressurizing chamber groups. The relative arrangements of the pressurizing chambers 10 in each pressurizing chamber group become the same, and each pressurizing chamber group is arranged with a slight offset in the longitudinal direction of the head body 2*a*. These pressurizing chambers 10 are arrayed in a region facing the piezoelectric actuator substrate 21 in the upper surface of the passage member 4 over almost the entire surface, although there is a portion having a bit wider distance such as the part between the pressurizing chamber groups. Further, the opening of each pressurizing chamber 10 is closed by joining the piezoelectric actuator substrate 21 to the upper surface of the passage member 4.

From the corner portion in each pressurizing chamber 10 which is opposite to the corner portion linked with the individual supply channel 14, a descender 16 which is linked with a discharge opening 8 opened in the discharge surface 4-1 of the lower surface of the passage member 4 extends. The descender 16, when viewed on a plane, extends in a direction of extension of a diagonal line of the pressurizing chamber 10. That is, in the longitudinal direction, the arrangement of the discharge opening 8 and the arrangement of the pressurizing chamber 10 become the same. In each pressurizing chamber row 11, the pressurizing chambers 10 are aligned at distances of 37.5 dpi. The pressurizing chambers 10 connected to one manifold 5 are arranged at distances of 150 dpi in the longitudinal direction as a whole. Further, the pressurizing chambers 10 connected to four manifolds 5 are arranged with offset in the longitudinal direction at distances corresponding to 600 dpi, therefore the pressurizing chambers 10 are formed at distances of 600 dpi in the longitudinal direction as a whole. As explained before, the arrangement of discharge openings 8 in the longitudinal direction becomes the same as that of pressurizing chambers 10, therefore the distances of the discharge openings 8 in the longitudinal direction become 600 dpi.

In other words, this means that four discharge openings 8 linked with each manifold 5, that is, 16 discharge openings 8 in total, are arranged at equal distances of 600 dpi in a range of a virtual straight line R shown in FIG. 4 when projecting the discharge openings 8 so as to be perpendicular to the virtual straight line parallel to the longitudinal direction of the passage member 4. Due to this, by supplying ink of the same color to all manifolds 5, it becomes possible to form an image with a resolution of 600 dpi in the longitudinal direction as a whole. Further, the discharge openings 8 in four rows linked with one manifold 5 are arranged at equal distances of 150 dpi within the range of R of the virtual straight line. Due to this, by supplying different colors of ink to the manifolds 5, formation of four-color images with a resolution of 150 dpi in the longitudinal direction becomes possible as a whole. In this case, a four-color image may be formed with a resolution of 600 dpi by further using four liquid discharge heads 2 and supplying ink of different colors to the manifolds 5 at different positions in each liquid discharge head 2 as well. Furthermore, a four-color image may be formed with a resolution of 300 dpi by using two liquid discharge heads 2 and supplying ink of different colors to the manifolds 5 at different positions in each liquid discharge head 2 as well.

An individual electrode 25 is formed at a position in the upper surface of the piezoelectric actuator substrate 21 that faces each pressurizing chamber 10. The individual electrode 25 includes an individual electrode body which is one size smaller than the pressurizing chamber 10 and has a shape substantially similar to that of the pressurizing chamber 10 and a lead-out electrode 25*b* which is led out from the individual electrode body 25*a*. The individual electrodes 25, in the same way as the pressurizing chambers 10, form individual electrode columns and individual electrode groups. Further, on the upper surface of the piezoelectric actuator substrate 21, common electrode-use surface electrodes 28 electrically connected to a common electrode 24 are formed. Two columns of common electrode-use surface electrodes 28 are formed in the central part of the transverse direction of the piezoelectric actuator substrate 21 so as to follow along the longitudinal direction. One column of these is formed along the transverse direction near the end in the longitudinal direction. The common electrode-use surface electrodes 28 shown are intermittently formed on a straight line. However, they may be continuously formed on a straight line as well. Two signal transmission parts are arranged so as to head toward the center from the sides of two long sides of the piezoelectric actuator substrate 21, and they are joined to the piezoelectric actuator substrate 21. The common electrode-use surface electrodes 28 are connected at the end parts of the signal transmission parts (tips and ends of the piezoelectric actuator substrate 21 in the longitudinal direction). The common electrode-use surface electrodes 28 and common electrode-use connection electrodes formed on the same have areas larger than the lead-out electrodes 25*b* and connection electrodes 26 formed on the same, therefore peeling off of the signal transmission parts from the ends can be made difficult.

Further, the discharge openings 8 are arranged at positions avoiding regions facing the manifolds 5 arranged on the lower surface side of the passage member 4. Further, the discharge openings 8 are arranged within regions which face the piezoelectric actuator substrate 21 on the lower surface side of the passage member 4. These discharge openings 8 occupy, as one group, a region having almost the same size and shape as the piezoelectric actuator substrate 21. Droplets can be discharged from the discharge openings 8 by operating the corresponding displacement elements 30 of the piezoelectric actuator substrate 21.

The passage member 4 included in the head body 2*a* has a multilayer structure comprised of a plurality of plates stacked together. These plates are, in order from the upper surface of the passage member 4, a cavity plate 4*a*, base plate 4*b*, aperture plate 4*c*, supply plate 4*d*, manifold plates 4*e* to 4*g*, cover plate 4*h*, and nozzle plate 4*i*. In these plates, large numbers of openings and grooves are formed. By making the thicknesses of the plates about 10 to 300 μm, the accuracy of formation of the openings and grooves which are formed can be raised. The plates are positioned and stacked so that these openings and grooves communicate with each other to configure passages such as the individual passages 12 and manifolds 5. The head body 2*a* has a configuration in which the pressurizing chambers 10 are arranged in the upper surface of the passage member 4, the manifolds 5 are arranged on the lower surface side in the internal portion, and the discharge openings 8 are arranged in the lower surface, thereby the portions configuring the individual passages 12 are arranged at different positions so as to be close to each other, and the manifolds 5 and the discharge openings 8 are linked through the pressurizing chambers 10.

The plates 4*a* to 4*i* are stacked through an adhesive. The thicknesses of the layers of adhesive are 0.1 to 3 μm or so. FIG. 5A and FIG. 5B are drawn by omitting the layers of adhesive. On the peripheries of the openings and grooves which become the passages, adhesive spill grooves 19 and adhesive spill holes 18 are arranged. They will be explained in detail later.

The openings formed in the plates 4*a* to 4*i* in the passage member 4 will be explained next. As these openings, there are following ones. First, there is a pressurizing chamber 10 formed in the cavity plate 4*a*. Secondly, there are communication openings configuring an individual supply channel 14 leading from one end of the pressurizing chamber 10 to the manifold 5. This communication opening is formed in each of the plates from the base plate 4*b* (in more detail, an inlet of the pressurizing chamber 10) to the supply plate 4*c* (in more detail, an outlet of the manifold 5). Note that, this individual supply channel 14 includes a aperture 6 long in one direction when viewed on a plane and formed in the aperture plate 4*c* as a location where the cross-sectional area of the passage becomes small.

Thirdly, there are communication openings configuring a passage which is communicated from the other end of the pressurizing chamber 10 to the discharge opening 8, that is, the descender 16. The descender 16 is formed in each of the plates from the base plate 4*b* (in more detail, the outlet of the pressurizing chamber 10) to the nozzle plate 4*i* (in more detail, the discharge opening 8). Fourthly, there are communication openings configuring the manifold 5. The communication openings are formed in the manifold plates 4*e* to 4*g*.

The first to fourth communication openings are linked with each other and configure an individual passage 12 which extends from the inflowing port of the liquid from the manifold 5 (outlet of the manifold 5) up to the discharge opening 8. The liquid supplied to the manifold 5 is discharged from the discharge opening 8 by the following route. First, it heads upward from the manifold 5, passes through the entrance of the individual supply channel 14, and reaches one end part of the aperture 6. Next, it proceeds horizontally along the direction of extension of the aperture 6 and reaches the other end part of the aperture 6. It travels therefrom toward the upper part and reaches one end part of the pressurizing chamber 10. Further, it proceeds horizontally along the direction of extension of the pressurizing chamber 10 and reaches the other end part of the pressurizing chamber 10. From there, it moves through the descender 16 little by little in the horizontal direction while mainly heading downward and proceeds to the discharge opening 8 formed in the lower surface.

The piezoelectric actuator substrate 21 has a common electrode 24 which is made of Ag—Pd or another metal material and individual electrodes 25 made of Au or another metal material. The thickness of the common electrode 24 is about 2 μm, and the thicknesses of the individual electrodes 25 are about 1 μm.

Each of the individual electrodes 25 is arranged at a position facing a pressurizing chamber 10 in the upper surface of the piezoelectric actuator substrate 21. An individual electrode 25 includes an individual electrode body 25*a* which is one size smaller than the pressurizing chamber body 10*a* in planar shape and has a shape substantially similar to that of the pressurizing chamber body 10*a* and a lead-out electrode 25*b* which is led out from the individual electrode body 25*a*. In a portion on one end of the lead-out electrode 25*b* which is led out to the outside of the region facing the pressurizing chamber 10, a connection electrode 26 is formed. The connection electrode 26 is made of for example a conductive resin including silver particles or other conductive particles and is formed to a thickness of about 5 to 200 μm. Further, the connection electrode 26 is electrically joined to the electrode provided in the signal transmission part.

Further, on the upper surface of the piezoelectric actuator substrate 21, the common electrode-use surface electrodes 28 are formed. The common electrode-use surface electrodes 28 and the common electrode 24 are electrically connected through not shown through-conductors arranged in a piezoelectric ceramic layer 21*b*.

As will be explained in detail later, drive signals are supplied from the control part 88 through the signal transmission parts to the individual electrodes 25. The drive signals are supplied by a constant period synchronous to the conveyance speed of the printing medium P.

The common electrode 24 is formed over almost the entire surface in the surface direction in the region between the piezoelectric ceramic layer 21*b* and the piezoelectric ceramic layer 21*a*. That is, the common electrode 24 extends so as to cover over all of the pressurizing chambers 10 in the region facing the piezoelectric actuator substrate 21. The common electrode 24 is linked through via holes formed so as to penetrate through the piezoelectric ceramic layer 21*b* with the common electrode-use surface electrodes 28 formed at positions away from the electrode group configured by individual electrodes 25 on the piezoelectric ceramic layer 21*b*. Further, the common electrode 24 is grounded and is held at the ground potential. The common electrode-use surface electrodes 28, in the same way as the plurality of individual electrodes 25, are directly or indirectly connected to the control part 88.

A portion sandwiched between an individual electrode 25 and the common electrode 24 in the piezoelectric ceramic layer 21*b* is polarized in the thickness direction and becomes a displacement element 30 of a unimorph structure which displaces when a voltage is applied to the individual electrode 25. More specifically, when the individual electrode 25 is given a potential different from that for the common electrode 24 and an electric field is applied to the piezoelectric ceramic layer 21*b* in its polarization direction, the portion to which this electric field is applied acts as an active part which deforms according to the piezoelectric effect. In this configuration, if an individual electrode 25 is made a positive or negative predetermined potential with respect to the common electrode 24 by the control part 88 so that the electric field and the polarization become the same direction, the part (active part) sandwiched between the electrodes in the piezoelectric ceramic layer 21*b* contracts in the planar direction. On the other hand, the inactive layer piezoelectric ceramic layer 21*a* is not influenced by the electric field, therefore this does not autonomously contract, but works to restrict deformation of the active part. As a result of this, a difference arises in strain in the polarization direction between the piezoelectric ceramic layer 21*b* and the piezoelectric ceramic layer 21*a* and the piezoelectric ceramic layer 21*a* is deformed so as to protrude to the pressurizing chamber 10 side (unimorph deformation).

Next, a discharge operation of the liquid will be explained. The displacement elements 30 are driven (displaced) according to drive signals supplied to the individual electrodes 25 through a driver IC or the like under control from the control part 88. In the present embodiment, the liquid can be discharged by a variety of drive signals. However, here, the so-called "pull driving" method will be explained.

The individual electrodes 25 are made a potential higher than the common electrode 24 (below, referred to as a "high potential") in advance, the individual electrodes 25 are once made the same potential as that of the common electrode 24 (below, referred to as a "low potential") whenever a discharge request is issued, then are made a high potential again at a predetermined timing. Due to this, at a timing when the individual electrodes 25 become a low potential, the piezoelectric ceramic layers 21*b* and 21*a* (begin to) return to their original (flat) shape, so the pressurizing chambers 10 increase in volume compared with their initial state (state where the potentials of the two electrodes are different). Due to this, a negative pressure is given to the liquid in the pressurizing chambers 10. This being so, the liquid in the pressurizing chambers 10 begins to vibrate by a natural vibration period. Specifically, first, the pressurizing chambers 10 begin to increase in volume and the negative pressure gradually becomes smaller. Next, the pressurizing chambers 10 become maximum in volume and the pressure becomes substantially zero. Then, the pressurizing chambers 10 begin to be reduced in volume and the pressure becomes higher. After that, at the timing that the pressure becomes substantially maximum, the individual electrodes 25 are made a high potential. If doing this, the vibration which was applied first and the vibration which is applied next become superposed, therefore a larger pressure is applied to the liquid. This pressure is propagated in the descenders to discharge the liquid from the discharge openings 8.

That is, by supplying to the individual electrodes 25 drive signals of pulses made a low potential for a constant period based on the high potential, droplets can be discharged. If this pulse width is made the time of half of the natural vibration period of the liquid in the pressurizing chambers 10, that is, the AL (acoustic length), in principle, it is possible to make the discharge speed and discharge amount of the liquid maximum. The natural vibration period of the liquid in the pressurizing chambers 10 is greatly influenced by the physical properties of the liquid and the shape of the pressurizing chambers 10. Other than these, it is also influenced by the physical properties of the piezoelectric actuator substrate 21 and characteristics of the passages linked with the pressurizing chambers 10.

Here, the adhesive spill holes 18 and adhesive spill grooves 19 will be further explained. The passage member 4 is comprised of the plates 4*a* to 4*i* stacked through an adhesive. In the plates 4*a* to 4*i*, openings and grooves which become the passages are arranged. Therefore, at the time of stacking, a portion of the adhesive is liable to flow into the openings and grooves. If a large amount of adhesive flows into them, the passages may become clogged. Even if the amount is not large enough to cause clogging, the discharge characteristics of the liquid may change due to a change of the cross-sectional area of the passages and a change of the passage characteristics.

Unless the amount of the adhesive is large enough to spread over the entire surfaces among the plates 4*a* to 4*i* when bonding and stacking the plates 4*a* to 4*i*, portions which are not bonded will be formed. If pressing and bonding the plates 4*a* to 4*i* in a state where the adhesive spreads over their entire surfaces, a portion of the adhesive will end up flowing into the passages.

Therefore, spill holes 18 and spill grooves 19 are formed around the openings and grooves which become the passages. The spill holes 18 and spill grooves 19 are basically recesses formed in the plates 4*a* to 4*i*. They are formed by half-etching the plates 4*a* to 4*i* or the like. However, the spill holes 18 and spill grooves 19 may penetrate through the plates 4*a* to 4*i* as well. Such forms are also called "spill holes 18" and "spill grooves 19".

If there are spill holes 18 and spill grooves 19, at the time of stacking, a portion of the adhesive will flow into the spill holes 18 and spill grooves 19. For this reason, the amount of the adhesive which flows into the passages will become smaller. As a result, it will become harder for the passages to clog. Further, fluctuation of the passage characteristics can be made smaller. The adhesive flows into the passages from the entire surroundings of the passages. However, by arranging the spill holes 18 and spill grooves 19 so as to surround the passages, flow of the adhesive into the passages can be suppressed.

The spill holes 18 are basically circular or polygonal in planar shape. In the spill holes 18, the ratio of the length in the longitudinal direction relative to the length in the transverse direction is 3 or less, preferably 2 or less. The planar shape of the spill grooves 19 is one where the ratio of the length in the longitudinal direction of the spill grooves 19 relative to the length in the transverse direction is larger than that of the spill holes 18.

The following two actions influence the suppression of flow of adhesive into the passages by the spill holes 18 and spill grooves 19: The first action is that the adhesive does not flow beyond the spill holes 18 and spill grooves 19. Usually the adhesive is not supplied in so large an amount that the spill holes 18 and spill grooves 19 end up being completely filled by the adhesive. For this reason, the adhesive which once flows into the spill holes 18 and spill grooves 19 almost never flows over the spill holes 18 and spill grooves 19 to flow into the passages.

If the surroundings of the passages were encircled by spill grooves 19 without break, the flow of the adhesive from the outside of the spill grooves 19 will be almost entirely eliminated. As a result, the adhesive liable to flow into the passages would become just the adhesive supplied to the bonding areas of the regions surrounded by the spill grooves 19. That is, such a structure would have a high effect of suppressing flow of the adhesive into the passages. However, if employing such a structure, when the spill grooves 19 and the passages became connected and leakage occurred, the fluctuation of the passage characteristics would become large since the spill grooves 19 extend long.

The second action is that the adhesive which is supplied to the bonding areas between the spill holes 18 and spill grooves 19 and the passages generally flows into the nearest one among the spill holes 18, spill grooves 19, and passages. Due to this action, even if the surroundings of the passages are not encircled by the spill grooves 19 without break, the amount of the adhesive flowing into the passages can be reduced.

Figure 6A:
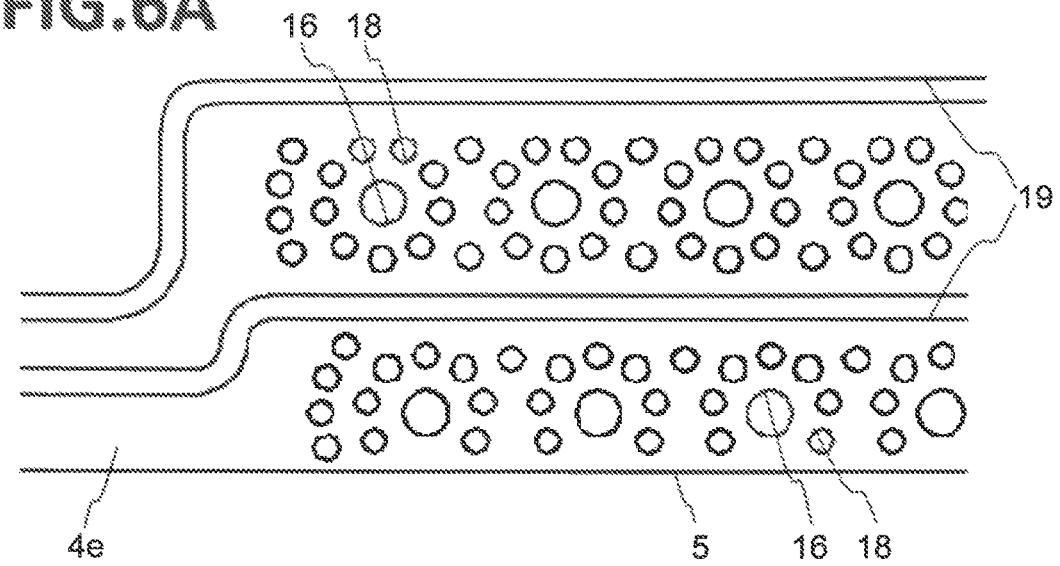
FIG. 6A is a plan view of a plate.

The specific arrangement of the spill holes 18 and spill grooves 19 will be explained next. FIG. 6A is a plan view of the portion of two-dot chain line in FIG. 4 in the plate 4*e*. In the plate 4*e*, through holes forming the manifolds 5 are formed. In the passage member 4, two each discharge opening rows 9 are arranged at the two sides of one manifold 5. In the plate 4*e*, although the position in the planar direction is offset a little, descenders 16 penetrating through the plate 4*e* are arranged at substantially the same positions as the discharge openings 8. That is, in the plate 4*e*, two each rows of openings (below, sometimes referred to as the "descender openings 16") forming descenders 16 are arranged on the two sides of the manifold 5. In FIG. 6A, 2 rows of descender openings 16 arranged on one side of the manifold 5 are drawn. Spill holes 18 which are circular and have about a half depth of the thickness of the plate 4*e* are arranged so as to surround the descender openings 16. Further, between the two rows of descender openings 16, a spill groove 19 having about a half depth of the thickness of the plate 4*e* is arranged. Further, in the range of the manifold 5 where no descender openings 16 are arranged, a spill groove 19 is arranged along the edge of the manifold 5.

Basically, among the openings and grooves which form the passages, the spill holes 18 are arranged around those having small opening areas while the spill grooves 19 are arranged around those having large opening areas. More specifically, the spill holes 18 are arranged around the openings in which the liquid would flow in the stacking direction of the plates 4*a* to 4*i* among the openings forming the individual passages 12 such as the descenders 16. In passages in which liquid flows in the stacking direction, due to stacking offset or the like, the possibility of the spill holes 18 and spill grooves 19 on the periphery ending up being connected to becomes high. Therefore, preferably, not spill grooves 19, but spill holes 18 are arranged.

Below, a case where spill holes 18 are arranged around a descender opening 16 will be explained. A descender 16 is a passage connecting a pressurizing chamber 10 and the discharge opening 8. This is a passage having a particularly large influence upon the discharge characteristics when the passage characteristics fluctuate. By reducing the fluctuation of passage characteristics of the descender 16, the variation of discharge characteristics can be made smaller.

If a ring-shaped spill groove 19 is arranged around a descender opening 16, the fluctuation of discharge characteristics which occurs when the descender 16 and the spill groove 19 are connected due to stacking offset of the plates 4*a* to 4*i* or local bonding failure becomes larger. If the liquid enters into the spill groove 19, the spill groove 19 acts as a passage added to the descender 16 and the passage characteristics change, so the discharge characteristics change. Even if the liquid does not enter into the spill groove 19, air remaining in the spill groove 19 acts as an air damper, therefore the discharge characteristics end up changing.

Therefore, a plurality of independent spill holes 18 are arranged around a descender opening 16. Due to this, even if the descender 16 and a spill hole 18 end up becoming connected, basically only one spill hole 18 causes fluctuation of the characteristics of the descender 16, therefore the effect can be kept small.

The two actions of the spill holes 18 making flow of the adhesive into a descender opening 16 harder were as explained above. In both of the actions, the further the position of a spill hole 18 from the descender 16, the smaller the effect of suppression of inflow of the adhesive. Further, the closer a spill hole 18 relative to the descender opening 16, the easier it is for the descender 16 and the spill hole 18 to end up becoming connected because of stacking offset and the narrow bonding area. Therefore, the spill holes 18 are arranged at substantially the same distance from the edge of the descender opening 16. Due to this, the amount of flow of the adhesive into the descender opening 16, which is liable to become larger if some of the spill holes 18 are too far from the descender opening 16, can be made smaller. Further, leakage, which is liable to occur if some of the spill holes 18 are too close to the descender opening 16, can be made more difficult. Here, the term "substantially the same distance" means that the distance of the closest spill hole 18 from the edge of the descender opening 16 becomes 50% or more with respect to the distance of the most distant spill hole 18 from the edge of the descender opening 16, more preferably 80% or more, and particularly preferably 90% or more.

The spill holes 18 may be shaped so as to extend along the circumference of a concentric circle centered about the descender opening 16. However, if the ratio of the longitudinal direction of a spill hole 18 relative to the transverse direction becomes larger, the influence at the time of occurrence of leakage becomes larger. Therefore, the ratio is desirably small. Preferably the ratio is made 1, the length is prevented from increasing in any specific direction, and the shape is circular.

By arranging the spill holes 18 so as to surround the descender opening 16, inflow of the adhesive from the outer circumference of the descender opening 16 is suppressed. Therefore, basically three or more holes are arranged around the descender opening 16. However, if there is another passage or the like near the periphery, sometimes just two spill holes 18 may be arranged. For example, in the descender opening 16 near the manifold 5 in FIG. 6A, the manifold 5 is arranged near the lower side of the descender opening in the drawing. Therefore, the necessity of arrangement of spill holes 18 in the direction of arrangement of the manifolds 5 is low. In such a case, two spill holes 18 and a opening which becomes the manifold 5 may be arranged so as to surround the descender opening 16.

By that the opening area of a spill hole 18 becoming smaller than the opening area of the descender 16, fluctuation of the passage characteristics of the descender 16 when the descender 16 and the spill hole 18 become connected can be reduced.

When the spill holes 18 are arranged so as to surround a descender opening 16 at substantially the same distances, as shown in FIG. 6A, preferably other spill holes 18 are arranged on further the outer side of those spill holes 18. The outer side spill holes 18 are arranged so that, when viewed from the descender opening 16, each overlaps the clearance between adjacent spill holes 18 among the inner side spill holes 18. The first action explained above occurs even according to the spill holes 18. However, unlike the spill grooves 19, the spill holes 18 are not arranged around the descender opening 16 without break. For this reason, the adhesive is liable to flow into the descender opening 16 from the space between inner side spill holes 18 which are adjacent to each other. If the outer side spill holes 18 are arranged as explained above, it is possible to make it harder for the adhesive to flow into the descender opening 16 from the spaces between the inner side spill holes 18 adjacent to each other.

Next, the arrangement of the spill holes 18 in a case where the plates having the descender openings 16 arranged therein are continuously stacked will be explained. FIG. 5B is a vertical cross-sectional view enlarging the plates 4*e* to 4*g* in FIG. 5A. the descender openings 16 are respectively arranged in the plates 4*e* to 4*g*. In design, the descenders 16 are connected from the top to the bottom in FIG. 5B and are arranged so as to be offset rightward in the drawing little by little in the direction from the top to the bottom, that is, from the plate 4*e* to the plate 4*g*. FIG. 5B shows a state where the plate 4*f* is stacked with a leftward offset relative to the design.

In FIG. 5B, the plate 4*f* is defined as the first plate 4*f*. At the first plate 4*f*, a first descender opening 16A is arranged as the descender opening 16 and a first spill hole 18A is arranged as the spill hole 18. Further, the plate 4*e* is defined as the second plate 4*e*. At the second plate 42, a second descender opening 16B is arranged as the descender opening 16 and a second spill hole 18B is arranged as the spill hole 18.

Figure 6B:
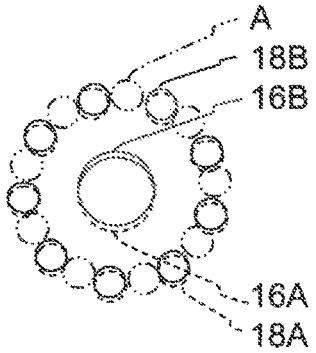
FIG. 6B is a plan view of spill holes in the plate in FIG. 6A and in another plate.

FIG. 6B is a plan view showing the second descender opening 16B and second spill holes 18B in the second plate 4*e* and the first descender opening 16A and first spill holes 18A in the first plate 4*f* from the second plate 4*e* side, that is, from the upper side. FIG. 6B is drawn enlarged more than FIG. 6A.

The design position of the first descender opening 16A in the first plate 4*f* is the position of the two-dot chain line of 16A-1. Since the first plate 4*f* is stacked more leftward than the design, the state as shown in FIG. 5B is exhibited.

Due to the stacking offset, the first spill hole 18A in the first plate 4*f* seen in the cross-section in FIG. 5B and the descender 16 end up being connected. Here, if the second spill hole 18B is arranged at the position A in the second plate 4*e*, the descender 16 also ends up connected with the spill hole 18B at the position A. Conversely speaking, unless the spill hole 18B is arranged at the position A, the possibility of leakage at two positions by the stacking offset at one position can be made lower. "A" is the opposite position of the first spill hole 18A with respect to the first descender opening 16A. Without arrangement of the spill hole 18B at this opposite position A, as explained above, the positions of occurrence of leakage can be decreased. Preferably, the second spill hole 18B is not arranged on not only one cross-section but also the opposite positions A corresponding to all the first spill holes 18A as shown in FIG. 6B.

Further, when such design is carried out, preferably, the spill holes 18 are arranged in rotational symmetry of order "n" ("n" is an odd number of 3 or more) with respect to a descender opening 16 in each plate, and the spill holes 18 in the plates which are stacked to be adjacent to each other are arranged at positions which are superimposed on each other. When arranging them in this way, even if the stacking positions of the plates are off and the descender 16 and one spill hole 18 end up being connected, at the opposite position A to that, no spill hole 18 is arranged, therefore leakage hardly ever occurs. Such an arrangement is particularly effective in a structure like the descender 16 wherein openings in which the liquid flows in the stacking direction are continuously connected in three or more layers.

Further, in such a structure, the opposite region A is arranged continuously in the stacking direction, therefore the bonding strength of the plates to each other can be made stronger. The reason for this is as follows: If there is a spill hole 18, pressure becomes harder to be transmitted in the up and down directions from that. Therefore, the bonding strength at that portion is liable to become weaker. However, if the opposite region A which is solid continues in the stacking direction, the bonding strength becomes stronger. Note that, in the descender opening 16 located on the upper side in the drawing in FIG. 6A, the spill holes 18 which are nearest to the descender opening 16 are arranged in rotational symmetry of order 9 with respect to the descender opening 16.

Figure 6C:
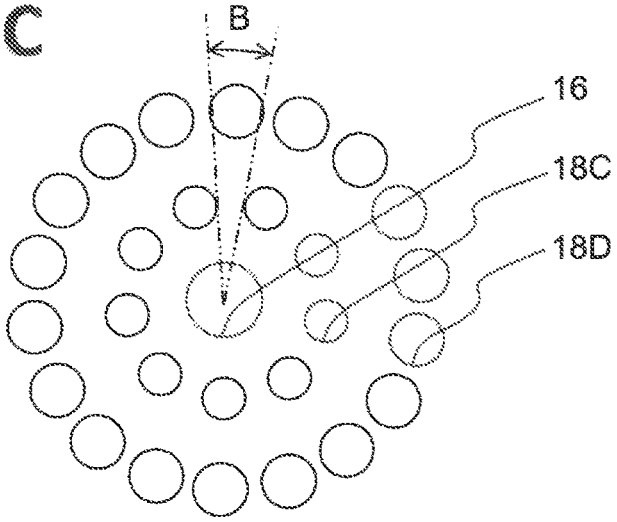
FIG. 6C is a plan view of a passage and spill holes in another embodiment.

FIG. 6C is a plan view of a descender opening 16, and third spill holes 18C and fourth spill holes 18D as spill holes 18 in another embodiment of the present disclosure. Such a structure can be used in place of the design of the surroundings of the descender opening 16 in FIG. 6A. Note that, in FIG. 6C, the rate of enlargement is larger than that in FIG. 6A. The actual size of the drawn descender opening 16 is the same.

The clearance between adjoining third spill holes 18C when viewed from the descender opening 16, in more detail, from the center of gravity of area of the descender opening 16, is a range of B. The fourth spill holes 18D are arranged on the outer side from the third spill holes 18C. some of the fourth spill holes 18D are arranged so as to overlap the clearances B between the third spill holes 18C when viewed from the descender opening 16. Due to such an arrangement, the adhesive supplied between the adjoining third spill holes 18C and the adhesive supplied to the outer side from that can be made harder to flow into the descender opening 16. So far as the fourth spill holes 18D overlap all of the clearances B among the third spill holes 18C when viewed from the descender opening 16, the adhesive can be made harder to flow into the descender opening 16.

Further, if the fourth spill holes 18D are larger than the third spill holes 18C when viewed from the descender opening 16, it is possible to make it more difficult for the adhesive to flow into the descender opening 16.

REFERENCE SIGNS LIST

1 . . . (color ink jet) printer
2 . . . liquid discharge head
2*a* . . . head body
4 . . . passage member
4*a* to 4*i* . . . plates (of passage member)
4-1 . . . discharge opening surface
4-2 . . . pressurizing chamber surface
5 . . . manifold (common passage)
5*a* . . . opening
6 . . . aperture
8 . . . discharge opening
9 . . . discharge opening row
10 . . . pressurizing chamber
11 . . . pressurizing chamber row
12 . . . individual passage
14 . . . individual supply channel
16 . . . descender (descender opening which becomes descender)
18 . . . spill hole
18A . . . first spill hole
18B . . . second spill hole
18C . . . third spill hole
18D . . . fourth spill hole
19 . . . spill groove
21 . . . piezoelectric actuator substrate
21*a* . . . piezoelectric ceramic layer (vibration plate)
21*b* . . . piezoelectric ceramic layer
24 . . . common electrode
25 . . . individual electrode
25*a* . . . individual electrode body
25*b* . . . lead-out electrode
26 . . . connection electrode
27 . . . dummy connection electrode
28 . . . common electrode-use surface electrode
30 . . . displacement element (pressurizing part)
70 . . . (head mounting) frame
72 . . . head group
80A . . . paper feed roller
80B . . . collection roller
82A . . . guide roller
82B . . . conveyor roller
88 . . . control part
A . . . opposite region (of spill hole)
P . . . printing paper

The invention claimed is:

1. A passage member comprising:

a plurality of plates that are stacked using an adhesive and configured with openings forming a passage through which a liquid flows, wherein a first plate of the plurality of plates is further configured with a plurality of first openings and a plurality of independent first adhesive spill holes arranged at substantially a same distance from one of the plurality of first openings and surround the one of the plurality of first openings.

2. The passage member according to claim 1, wherein each of opening areas of the plurality of first adhesive spill holes is smaller than an opening area of the one of the plurality of first openings.

3. The passage member according to claim 1, wherein the first adhesive spill holes arranged at the surroundings of the one of the plurality of first openings are arranged rotationally symmetrically.

4. The passage member according to claim 1, further comprising:

a second plate of the plurality of plates which is stacked on the first plate and comprises a plurality of second openings as the openings and a plurality of independent second adhesive spill holes arranged at substantially the same distance from one of the plurality of second openings and surround the one of the plurality of second openings, wherein the one of the plurality of first openings and the one of the plurality of second openings are connected, the second adhesive spill holes are arranged in a surface of the second plate at a side of the first plate, and when viewed on a plane, the second adhesive spill holes are not arranged at positions with respect to the one of the plurality of first openings opposite to the first adhesive spill holes.

5. The passage member according to claim 1, further comprising:

a second plate of the plurality of plates which is stacked on the first plate and comprises a plurality of second openings as the openings and a plurality of independent second adhesive spill holes arranged at substantially the same distance from one of the plurality of second openings and surround the one of the plurality of second openings, wherein, the one of the plurality of first openings and the one of the plurality of second openings are connected, the first adhesive spill holes are arranged in rotational symmetry of order "n" ("n" is an odd number of 3 or more), and when viewed on a plane, the second adhesive spill holes are arranged at positions the first adhesive spill holes.

6. The passage member according to claim 1, wherein:

the plurality of first adhesive spill holes arranged at substantially a first distance from the one of the plurality of first openings, and the first plate further comprises a plurality of independent second adhesive spill holes arranged at substantially a second distance from the one of the plurality of first openings and surround the one of the plurality of first openings, the second distance being longer than the first distance.

7. The passage member according to claim 6, wherein, when viewed from the opening, the second adhesive spill holes are arranged at positions that overlap clearances between two of the first adhesive spill holes arranged adjacent to each other.

8. The passage member according to claim 6, wherein, when viewed from the one of the plurality of first openings, size of the second adhesive spill holes are larger than the size of the first adhesive spill holes.

9. The passage member according to claim 1, wherein:

apertures of said first adhesive spill holes are circular shaped.

10. A liquid discharge head comprising:

the passage member according to claim 1, and pressurizing parts pressurizing the liquid in the passage.

11. A recording device comprising:

the liquid discharge head according to claim 10, a conveying part conveying a recording medium with respect to the liquid discharge head, and a control part controlling the liquid discharge head.

12. A passage member comprising:

a plurality of plates configured with openings forming a passage through which a liquid flows and stacked through an adhesive, wherein a first plate of the plurality of plates is further configured with a plurality of first openings as the openings and a plurality of independent first adhesive spill holes arranged on a circumference centered on one of the plurality of first openings and surround the one of the plurality of first openings.

13. A liquid discharge head comprising:

the passage member according to claim 12, and pressurizing parts pressurizing the liquid in the passage.

14. A recording device comprising:

the liquid discharge head according to claim 13, a conveying part conveying a recording medium with respect to the liquid discharge head, and a control part controlling the liquid discharge head.

* * * * *